US005738329A

United States Patent [19]

Woodard

[11] Patent Number: 5,738,329

[45] Date of Patent: Apr. 14, 1998

[54] CUT TREE OR ARTIFICIAL TREE STAND WITH CHAIN LATCHING MECHANISM

[76] Inventor: Robert W. Woodard, R.R. 2 Box 94, Frankfort, Kans. 66427

[21] Appl. No.: 753,960

[22] Filed: Dec. 3, 1996

[51] Int. Cl.[6] ..... F16M 13/00

[52] U.S. Cl. ..... 248/523

[58] Field of Search ..... 248/523, 524, 248/519, 511, 230.8

[56] References Cited

U.S. PATENT DOCUMENTS

| | | | |
|---|---|---|---|
| 1,540,856 | 6/1925 | Munro | 248/523 |
| 2,089,370 | 8/1937 | Heinrich et al. | 248/230.8 |
| 2,485,081 | 10/1949 | Ahrens | 248/524 |
| 2,499,753 | 3/1950 | Hubbard | 248/230.8 |
| 2,500,215 | 3/1950 | Swearingen | 248/524 X |
| 2,592,589 | 4/1952 | Harris | 248/523 |
| 3,136,519 | 6/1964 | Spriggel | 248/230.8 |
| 3,167,874 | 2/1965 | Pogue | 40/145 |
| 4,699,347 | 10/1987 | Kuhnley | 248/516 |
| 4,830,143 | 5/1989 | Fisher | 182/135 |
| 4,901,971 | 2/1990 | Connelly | 248/523 |
| 5,362,024 | 11/1994 | Grinnen | 248/524 |

*Primary Examiner*—Ramon O. Ramirez
*Attorney, Agent, or Firm*—Kenneth W. Iles

[57] ABSTRACT

A stand for supporting and displaying cut trees includes a closed hexagonal base having three upwardly and inwardly projecting legs that converge in about the center of the hexagonal base and that support a V-shaped cradle having upper and lower cradle arms that contact the tree trunk on two sides at both an upper location and at a lower location. A chain latching mechanism tightly fastens a chain about the circumference of the tree at a location between the upper and lower cradle arms.

20 Claims, 4 Drawing Sheets

CUT TREE OR ARTIFICIAL TREE STAND WITH CHAIN LATCHING MECHANISM

BACKGROUND OF THE INVENTION

1. Field of the Invention

The present invention is related to an apparatus for securing a cut tree or an artificial tree in an upright position for display. More particularly, the present invention is directed to a tree stand having a frame constructed of metal rods and a latching chain mechanism for adjustably securing a tree trunk to an upstanding portion of the frame.

2. Description of Related Art Including Information Disclosed Under 37 C.F.R. Sections 1.97–1.99

It is often desired to display a tree that has been cut down whole, or an artificial tree, particularly for the Christian holiday of Christmas. Many types of stands have been developed for holding and displaying such trees indoors.

A common type of stand includes a water bowl having a plurality of screws threadably mounted about the perimeter of the stand, which are screwed into the tree trunk to support it. Typically, a plurality of legs extends outwardly of the bowl to provide stability for the tree.

Such stands are normally awkward to set up; require a significant amount of force to install the tree by turning the screws into the trunk; require disassembly for cleaning after use, which is more or less necessary to prevent corrosion of the screws and threaded apertures in the stand; and are difficult to use to provide a vertically oriented tree display when the tree trunk is either not straight or the lower end of the trunk is not square to the general direction of the trunk.

Therefore, there is a need for a cut tree stand that is simple and easy to use; that requires very little force for secure set up of a cut tree; that requires no cleaning after use; and that easily displays a tree vertically even when the general orientation of the trunk is not straight or the lower end of the trunk is not square to the general direction of the trunk.

SUMMARY OF THE INVENTION

Accordingly, it is a primary object of the present invention to provide a cut tree, or artificial tree, stand that is simple and easy to use;

It is another object of the present invention to provide a cut tree, or artificial tree, stand that requires very little force for secure set up of a cut tree;

It is another object of the present invention to provide a cut tree, or artificial tree, stand that easily displays a tree vertically even when the general orientation of the trunk is not straight or the lower end of the trunk is not square to the general direction of the trunk.

A frame made of rods includes a base portion that is level and can be set on a level surface to provide stability for the tree. Upstanding portions of the frame provide a vertically oriented cradle for contacting a tree trunk along a pair of vertically spaced two cradle members intersecting at an angle in the range of 60–120 degrees, with 90 degrees being the preferred angle. A chain secured to a portion of the frame is wrapped around the tree trunk at a location below a pair of upper horizontal frame members, or upper cradle arms, that are perpendicular to one another and above a pair of lower horizontal frame members, or lower cradle arms, that are perpendicular to one another, and is secured to a spring-loaded latch that tightens the chain and holds it securely against the trunk of the tree.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

A separate water bowl is placed under the tree trunk for holding water to extend the useful life of the cut tree.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiment disclosed herein, however, is merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus disclosed herein as embodied in any appropriately specific and detailed structure.

Figure 1:
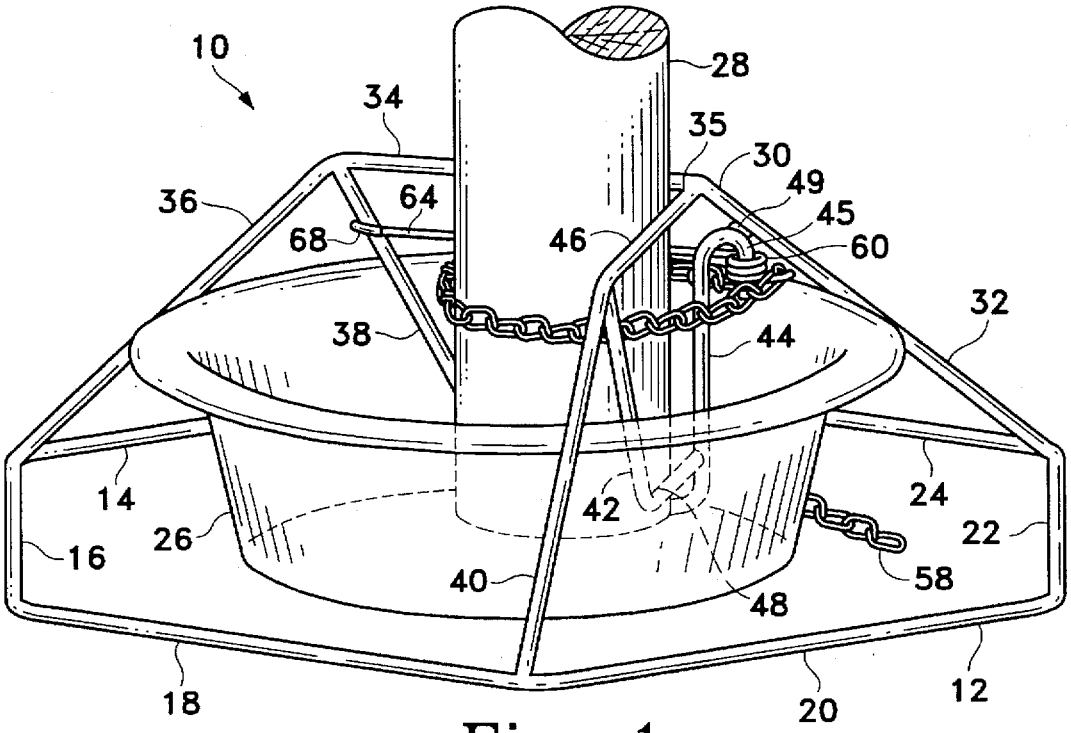
FIG. 1 is a right front perspective view of a cut tree stand with latching chain mechanism according to the present invention.
Figure 2:
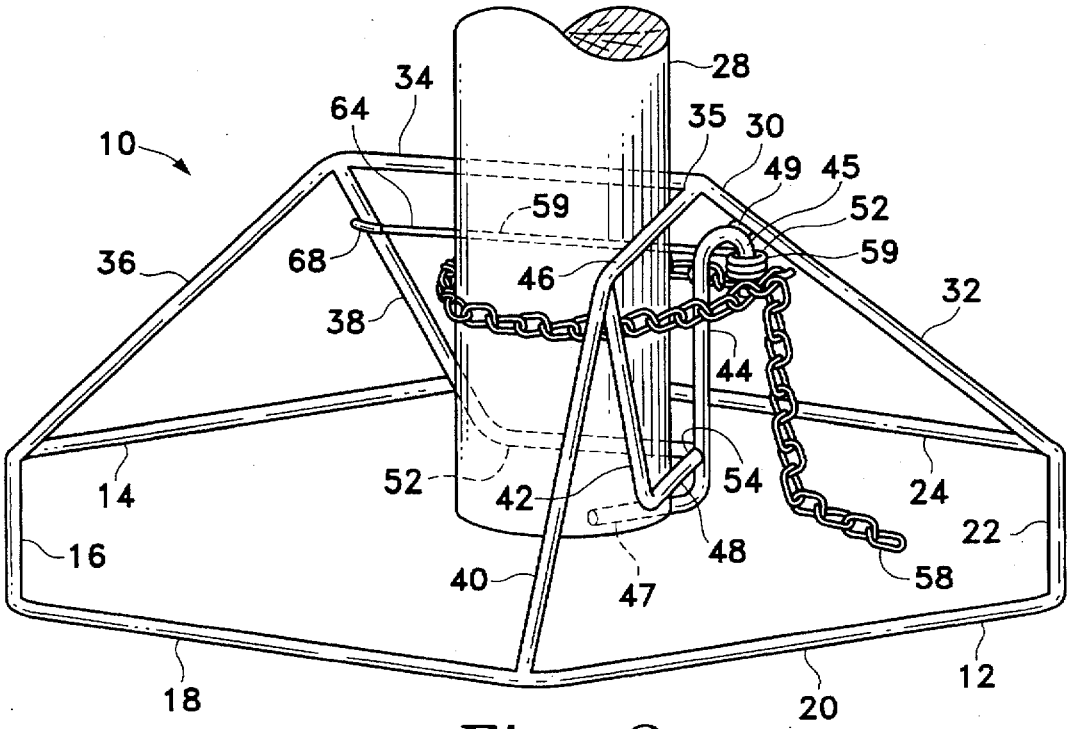
FIG. 2 is a right front perspective view of the cut tree stand of FIG. 1 with the water bowl removed.

Referring now to FIG. 1, a cut tree, or artificial tree, stand with chain latching mechanism, or cut tree stand, 10 according to the present invention includes a hexagonal base 12 consisting of six base-forming rods, or members, 14, 16, 18, 20, 22, and 24 of equal length that are connected one to the other to form a regular hexagon lying in a single plane for setting on a floor or other flat supporting surface. The hexagonal design of the base 12 provides a level of stability comparable to a circular base, but at a lower manufacturing cost. A separate water bowl 26 lies within the perimeter of the base 12 and is set in place under the tree trunk 28 after the tree is installed in the cut tree stand 10. The water bowl 26 holds water for extending the life of the cut tree and is preferably made of plastic, although it may also be made of metal or other convenient material.

A V-shaped cradle 30 supports the tree by embracing two sides of the tree trunk 28 at an upper location and at a lower location, both lying above the plane of the base 12. In designing the cut tree stand 10, the object was to support the V-shaped cradle 30 above the plane of the hexagonal base 12 with sufficient strength to support the cut tree 28 while using the minimum amount of structural material and the minimum number of bends.

This result was achieved by forming a rear leg 32 that is straight and rises upwardly and inwardly from the outer perimeter of the hexagonal base 12 from the joint between base rods 22 and 24 at an angle of 30–50 degrees of arc from the horizontal, with the preferred angle being 40 degrees. A right front leg 40 rises upwardly and inwardly of the outer perimeter of the hexagonal base 12 from the joint between base rods 18 and 20 at an angle within the range of 40–60 degrees of arc from the horizontal with the preferred angle being 45 degrees, and includes a 140 degree bend to form a right upper V-shaped cradle horizontal rod portion, or right upper cradle arm, 46. A left front leg 36, rises upwardly and inwardly of the outer perimeter of the hexagonal base 12 from the joint between base rods 14 and 16 at an angle within the range of 40–60 degrees of arc from the horizontal with the preferred angle being 45 degrees, and includes a 140 degree bend to form a left upper V-shaped cradle horizontal rod portion, or left upper cradle arm, 34. Similarly, the right front leg 40 and the left front leg 36 are identical and interchangeable parts that can be used for either the left or right leg during manufacture.

The V-shaped cradle 30 includes the left upper V-shaped cradle horizontal rod, or left upper cradle arm, 34 and the right upper V-shaped cradle horizontal rod, or right upper cradle arm, 46, which meet at a 90 degree angle, where they join the upper end of the rear leg 32, forming an upper cradle arm joint 35. The upper cradle arms 34, and 46 are perpendicular to one another and lie in approximately same plane, but may meet at an angle lying in the range of about 60–120 degrees. A vertical cradle reinforcing rod, or vertical rod, 44 includes a hook portion 45 at an upper end, which is fastened to the rear leg 32 by the weld bead 49. The vertical rod 44 projects downwardly to a 90 degree bend inward toward the center of the hexagonal base 12, forming a tree supporting foot 47 for maintaining some space between the bottom of the tree trunk 28 and the water bowl 26, thereby insuring complete contact between the bottom of the tree trunk 28 and the water in the water bowl 26.

A right lower cradle portion V-rod includes an upper end fastened to the right front leg 40 at a point adjacent to the bend defining the right upper V-shaped cradle horizontal rod, or right upper cradle arm, 46 at an angle lying in a range of about 60–80 degrees of arc relative to the rod portion, or right upper cradle arm, 46, with the preferred angle being 70 degrees. A bend of 110–130 degrees, with the preferred angle being 120 degrees, in the V-rod 42 forms a right lower horizontal V-shaped cradle member, or right lower cradle arm, 48, having an end 50 fastened to the lower end of the vertical cradle reinforcing rod 44. A member identical to the V-rod 42 forms a left lower cradle portion V-rod, or left lower cradle arm, 38, similarly fastened to the left front leg 36. A left lower horizontal V-shaped cradle member 52 includes an end 54 that is fastened to the vertical rod 44. The two lower horizontal V-shaped cradle members, or cradle arms, 48 and 52 meet at a 90 degree angle, but may form an angle lying in the range of about 60–120 degrees, to form a lower cradle arm joint 37 and lie in same plane, or in approximately the same plane.

There is a vertical space of approximately 4–6 inches (10–15 cm) between the upper V-shaped cradle members 34 and 46 and the lower V-shaped cradle members, or arms, 48 and 52. This space insures that irregular shaped or knotted tree trunks will be located and supported within the V-cradle 30.

The V-shaped cradle 30 therefore includes a pair of lower horizontal rods portions, or cradle arms, 48 and 52 that meet at 90 degrees, with a range of about 60–120 degrees being allowable, and lie in approximately the same plane and a pair of superposed upper horizontal rod portions 34 and 46 that meet at 90 degrees, with a range of 60–120 degrees being allowable, and lie in substantially the same plane, forming a V that contact two sides of the tree trunk 28 at two vertically spaced locations on the tree trunk 28. This arrangement provides four lines of contact between the V-cradle 30 and the tree trunk 28. These two spaced V-shaped members are joined by the vertical rod 44 to form the V-shaped cradle 30. The upper cradle arms 34 and 46 and the lower cradle arms 48 and 52 are horizontal when the cut tree stand 10 is in its display position, that is, the cradle arms 34, 46, 48 and 52 are all parallel to the base 12.

Figure 6:
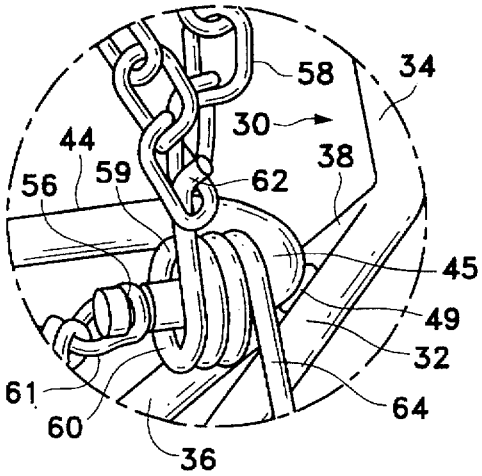
FIG. 6 is an enlarged view of the circled portion of FIG. 5 illustrating the attachment of the chain to the latch bar.

Referring now to FIG. 6, a groove 56 is formed in the lower end of the hook portion 45 of the vertical rod 44. A chain 58 has an end link 61 that is deformed to fit tightly into the groove 56. A coil spring latching mechanism 59 includes a coil spring 60 is slipped over the end of the hook portion 45 prior to attachment of the chain 58 in the groove 56. A lower end of the coil spring 60 includes an extension forming a chain hooking portion 62, while an upper end of the coil spring extends outwardly from the coil to form a spring tension latching member 64 having a latch hook 66 at a distal end, which is covered by a protective soft cap 68.

Figure 3:
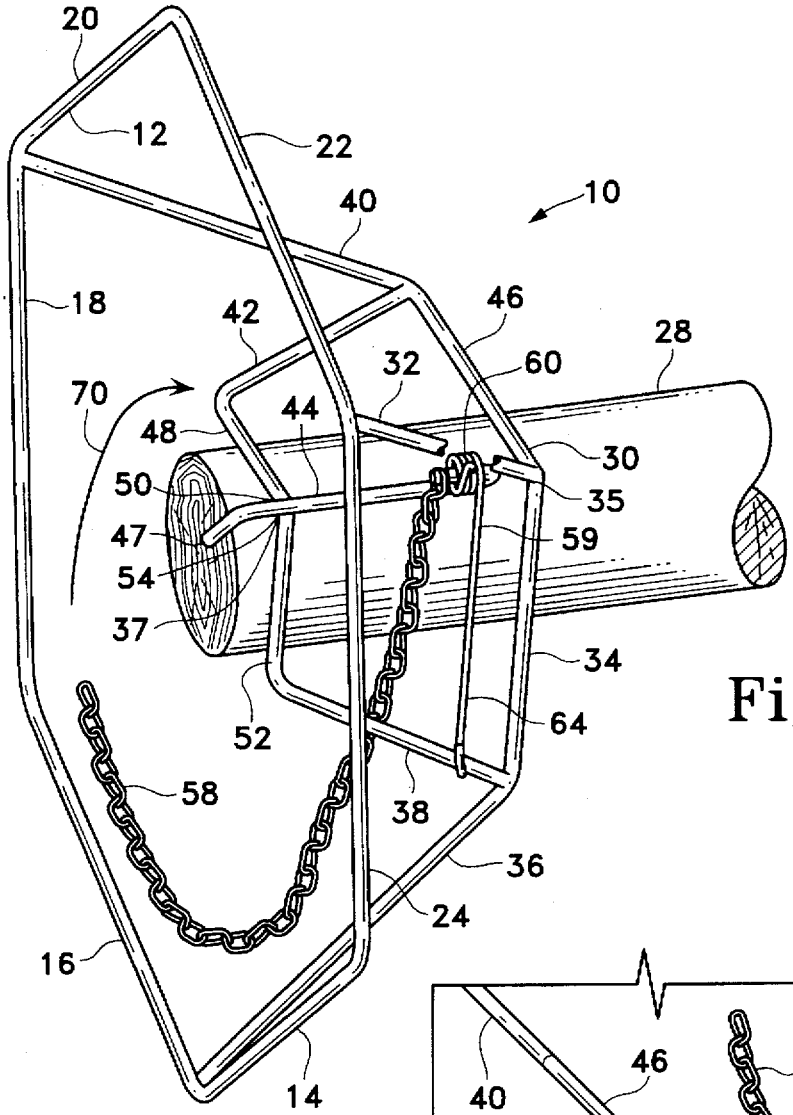
FIG. 3 is a right-hand side perspective view of the cut tree stand of FIG. 1 laid on its side and rotated approximately 180 degrees of arc counterclockwise when viewed from above as the device is shown in FIG. 1 and illustrating the installation of the cut tree into the cut tree stand and the application of the chain to a tree trunk.
Figure 4:
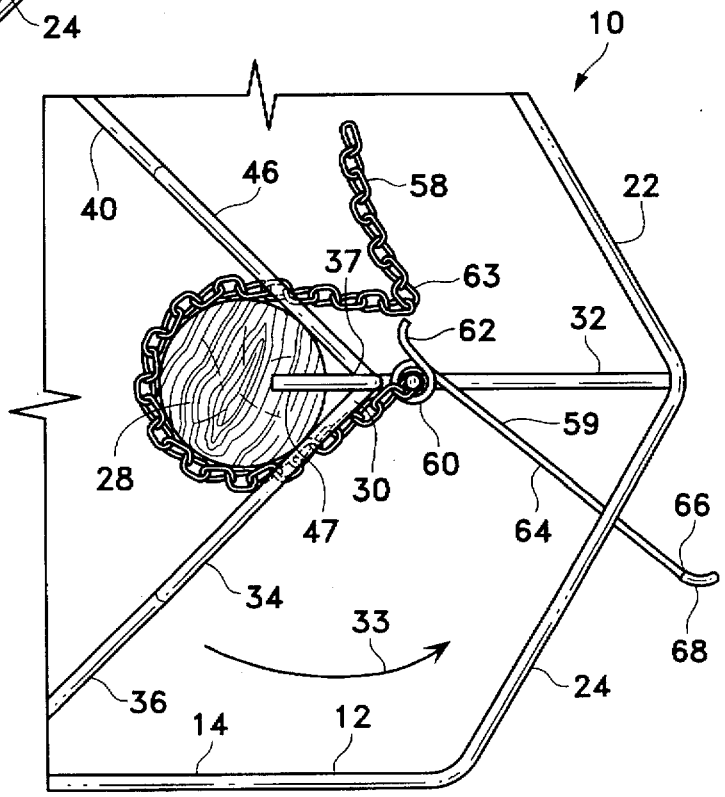
FIG. 4 is a bottom plan view of the cut tree stand of FIG. 1 achieved by turning the cut tree stand and tree upside down further illustrating the application of the chain to a tree trunk during set up.
Figure 5:
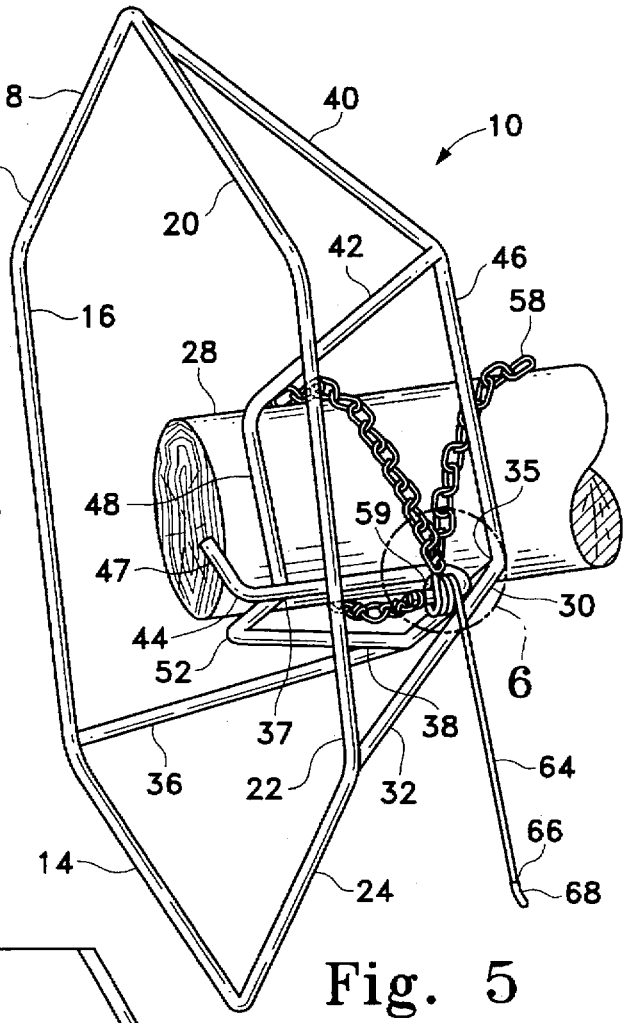
FIG. 5 is a side elevation of the cut tree stand of FIG. 1 and cut tree formed by lying the cut tree stand on its side as shown and rotating it approximately 180 degrees of arc counterclockwise from the position shown in FIG. 1 when viewed from the top and illustrates a further step in the installation of the chain about the tree trunk.
Figure 7:
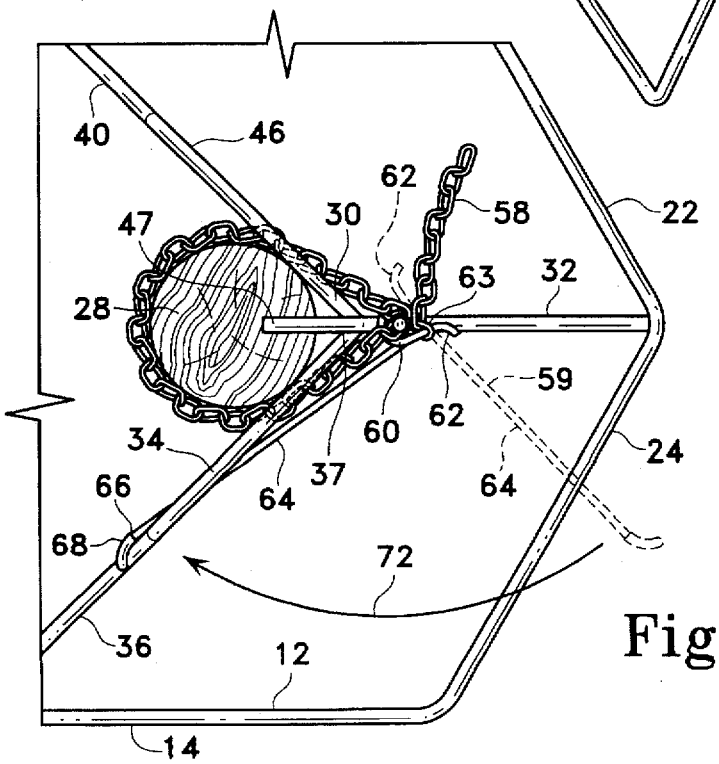
FIG. 7 is a bottom plan view of the cut tree stand of FIG. 1 achieved by turning the cut tree stand and tree assembly upside down illustrating the motion involved in latching the latch bar, or latching member, to secure the tree in the cut tree stand.
Figure 8:
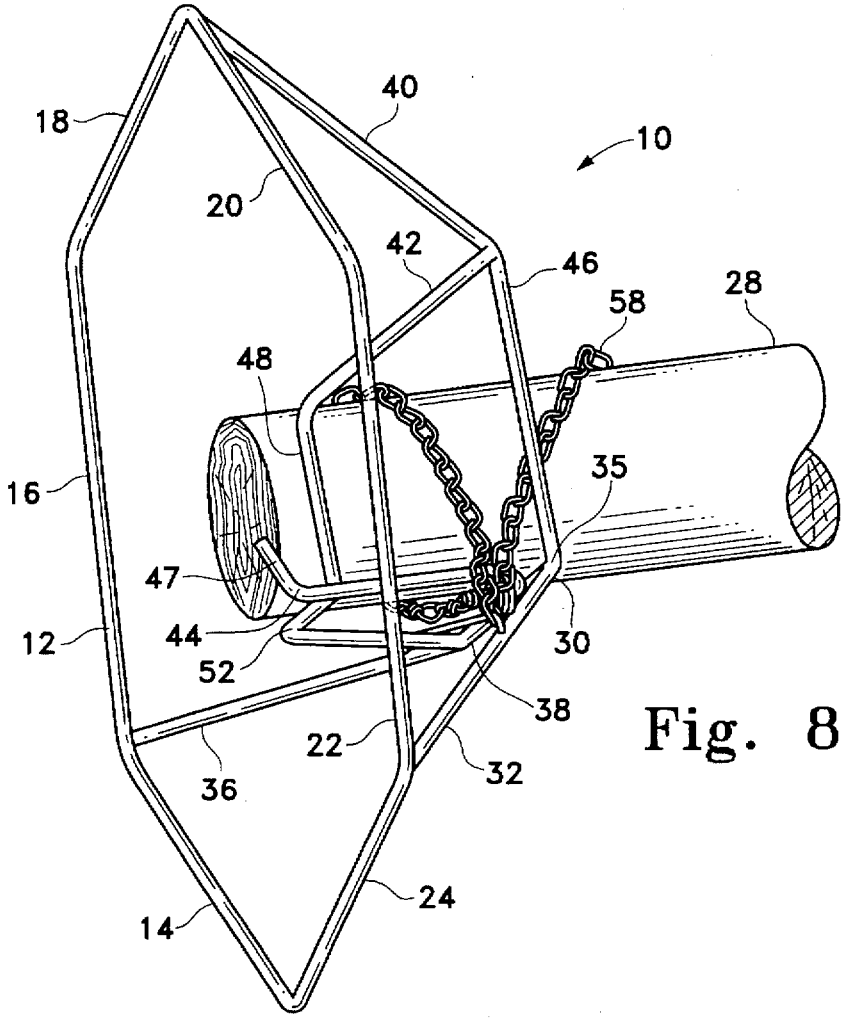
FIG. 8 is a perspective side view of the cut tree stand of FIG. 1 as shown in FIG. 5 illustrating the attachment of the cut tree fully attached to the cut tree stand.
Figure 9:
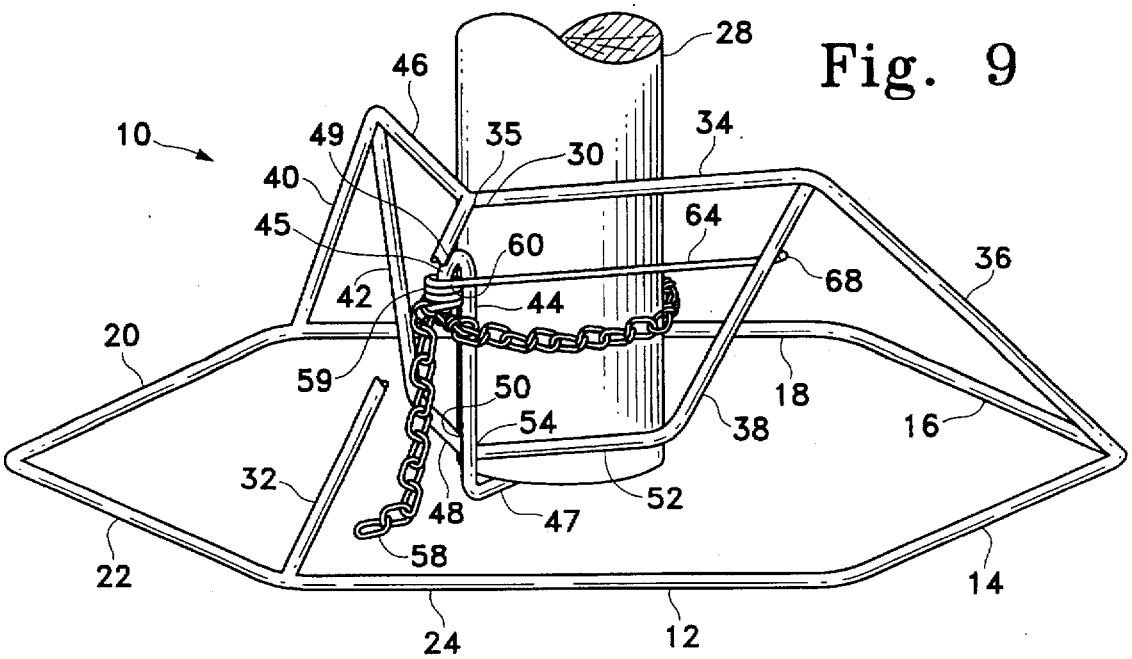
FIG. 9 is a rear perspective view of the cut tree stand of FIG. 1 achieved by rotating the cut tree stand as shown in FIG. 1 by approximately 180 degrees of arc when viewed from above showing the cut tree fully set up in the cut tree stand with the cut tree and cut tree stand vertically oriented in the display position.

Referring now to FIG. 3, the cut tree stand 10 is placed on its side and a cut tree is placed on its side and the bottom surface of the tree trunk 28 is butted against the tree supporting foot 47 and against the V-shaped cradle 30 members. The cut tree stand 10 is light weight and so it is generally preferred to manipulate the cut tree stand into place on the tree trunk. The chain 58 is wrapped about the tree trunk 28 in the direction of the arrow 70 so that the chain 58 lies between the upper cradle horizontal cradle arms, 34, 46 and the lower cradle arms 48, 52. Accordingly, the tree trunk 28 is contacted by three separate spaced structures, the upper cradle arms 34, 46, the chain 58, and the lower cradle arms 48, 52. The chain 58 encircles the entire tree trunk 28 when installation is complete. The chain 58 is pulled fairly tightly and the spring tension latching member 64 is rotated away from the left upper V-cradle horizontal rod 34 toward the rear leg 32, as shown by the arrow 33 in FIG. 4 and the chain link 63 (FIG. 4) closest to the chain hooking portion 62 of the coil spring 60 is slipped onto the chain hooking portion 62, resulting in the position shown in FIG. 5. The chain 58 is preferably placed about the tree trunk 28 in a manner such that it is not parallel to the cradle arms 34, 46, 48, and 52 to reduce the required supporting forces in the chain 58. If the chain 58 is wrapped about the tree trunk 28 in the opposite direction from the direction indicated, the latching member 64 will not tighten the chain 58. Further, the cradle arms 34, 46, 48, and 52 are round, that is rods, of sufficient diameter to prevent the cradle arms from cutting into the tree trunk 28 when the chain 58 is tightened. Referring now to FIG. 7, the latching member 64 is rotated in the direction of the arrow 72 toward the left upper V-cradle horizontal rod 34 and the latch hook 66 is hooked onto the cut tree stand, at a point on either the left upper V-cradle horizontal rod 34 or, preferably, onto the left lower cradle portion V-rod, or left lower cradle arm, 38. The rotation of the spring tension latching member 64 (and the coil spring 60) tightens the chain 58 against the tree trunk 28, holding it securely to the V-cradle 30. The coil spring 60 will rebound and the coil spring latching mechanism 59 will fail if too if the user attempts to use a tree that is too large or heavy of a cut tree stand 10 of any given capacity, which occurs without damage to any part of the cut tree stand 10. Then the cut tree 28 and cut tree stand 10 are turned into the upright display position as shown in FIG. 9. At the same time, the coil spring 60 serves to retain the tension on the chain 58 when the coil spring latching mechanism 59 is latched in the event that the chain 58 cuts into the tree trunk 28 slightly or the tree trunk 28 shrinks. The water bowl 26 is preferably placed on the floor at the point where the center of the hexagonal base 12 will be when the tree is erected. Then the water bowl 26 is filled with water and the cut tree is ready for display. The cut tree stand 10 can be easily covered with an ornamental skirt for decorative purposes.

In the preferred embodiment, the cut tree stand 10 is formed of steel rods, with all joints welded. The finished weldment portion of the cut tree stand 10, that is, the cut tree stand 10 except for the water bowl 26, the chain 58, and the coil spring 60, is painted or coated with plastic, such as tool dip, to provide a soft, pleasing, and rustproof finish. Alternatively, it may be chrome plated to provide corrosion protection.

While the present invention has been described in accordance with the preferred embodiments thereof, the description is for illustration only and should not be construed as limiting the scope of the invention. Various changes and modifications may be made by those skilled in the art without departing from the spirit and scope of the invention. For example, a base can be made from any number of frame members defining a closed polygon, such as a triangle, rectangle, pentagon, octagon, and so forth. The base can also be circular or other curved figure. The number of legs could be changed by, for example, eliminating the rear leg, which would weaken the structure, but would provide adequate support for smaller trees, or the number of legs could be increased. A base can also be made without forming a closed polygon, as for example, a plurality of outwardly radiating spoke members fastened together in the center and having a tree holding cradle or device attached to the center of the spoke members. Alternative materials could be employed and alternative fastening means could be used. Naturally, the cut tree stand can be modified by enlarging it to support larger trees, and other means for securing the chain may be used. For larger trees with a greater spacing between the upper and lower arms of the V-shaped cradle, more than one latching chain may be desirable, for example, two spaced chains. Therefore, the scope of invention should be that defined by the following claims.

I claim:

1. A cut tree stand comprising:

a. a base comprising a plurality of members connected to form a closed polygon;

b. a plurality of legs extending upwardly and inwardly of a perimeter of said base, each said leg having a lower end connected to said base;

c. a V-shaped cradle attached to an upper end of each said leg, said V-shaped cradle further comprising a plurality of superposed upper and lower cradle arms for contacting the trunk of a cut tree; and d. means for securing the tree trunk to said cradle connected to said V-shaped cradle.

2. A cut tree stand in accordance with claim 1 wherein each said upper cradle arm further comprises a portion of one said leg.

3. A cut tree stand in accordance with claim 1 wherein each said lower cradle arm further comprises a V-rod connected in depending relationship to one said leg.

4. A cut tree stand in accordance with claim 1 wherein said V-shaped cradle further comprises two upper cradle arms perpendicular to one another and fixed together at one end to form an upper cradle arm joint and two lower cradle arms perpendicular to one another and fixed together at one end to form a lower cradle arm joint.

5. A cut tree stand in accordance with claim 4 wherein said V-shaped cradle further comprises a vertical rod connected to an upper portion of one said leg and to said lower cradle arm joint.

6. A cut tree stand in accordance with claim 5 wherein said trunk securing means further comprises a coil spring latching mechanism comprising a coil spring mounted on a hook portion of said vertical rod, a chain hooking portion and a spring tension latching member.

7. A cut tree stand in accordance with claim 6 wherein said chain is secured to a groove in said hook portion of said vertical rod.

8. A cut tree stand in accordance with claim 5 wherein said upper cradle arms and said lower cradle arms each lie in a separate plane and both said planes are parallel to the plane of said base.

9. A cut tree stand in accordance with claim 1 wherein said base comprises a regular hexagon.

10. A cut tree stand comprising:

a. a base comprising a plurality of members connected to form a closed polygon;

b. a plurality of legs extending upwardly and inwardly of a perimeter of said base, each said leg having a lower end connected to said base;

c. a V-shaped cradle attached to an upper end of each said leg, said V-shaped cradle further comprising two lower cradle arms and two superposed upper cradle arms for contacting the trunk of a cut tree along four discrete lines; and d. means for securing the tree trunk to said cradle connected to said cradle.

11. A cut tree stand in accordance with claim 10 wherein said upper cradle arms and said lower cradle arms further comprise rods.

12. A cut tree stand in accordance with claim 10 wherein said base further comprises a regular hexagon.

13. A cut tree stand in accordance with claim 10 further comprising three said legs.

14. A cut tree stand in accordance with claim 10 wherein said V-shaped cradle further comprises two upper cradle arms perpendicular to one another and fixed together at one end to form an upper cradle arm joint and two lower cradle arms perpendicular to one another and fixed together at one end to form a lower cradle arm joint and a vertical rod connected to an upper portion cent to said upper arm cradle joint and to said lower cradle arm joint.

15. A cut tree stand in accordance with claim 14 wherein said trunk securing means further comprises a coil spring latching mechanism comprising a coil spring mounted on a hook portion of said vertical rod, a chain hooking portion and a spring tension latching member and said chain is secured to a groove in said hook portion of said vertical rod at a location below the location of said coil spring, whereby said chain retains said coil spring latching mechanism on said vertical rod.

16. A cut tree stand comprising:

a. a base comprising a plurality of members connected to form a regular hexagon;

b. a plurality of legs extending upwardly and inwardly of a perimeter of said base, each said leg having a lower end connected to said base;

c. a V-shaped cradle attached to an upper end of each said leg, said V-shaped cradle further comprising two lower cradle arms perpendicular to one another and joined together at one end of each said lower cradle arm forming a lower cradle arm joint and two superposed upper cradle arms joined together at one end of each said upper cradle arm forming an upper cradle arm joint for contacting the trunk of a cut tree along four discrete lines and a vertical rod connected to said lower cradle arm joint and to an upper portion of one said leg adjacent to said upper cradle arm joint; and d. a coil spring latching mechanism comprising a coil spring mounted on a hook portion of said vertical rod, a chain hooking portion and a spring tension latching member and said chain is secured to a groove in said hook portion of said vertical rod at a location below the location of said coil spring, whereby said chain retains said coil spring latching mechanism on said vertical rod.

17. A cut tree stand in accordance with claim 16 further comprising a bowl placed under said V-shaped cradle.

18. A cut tree stand in accordance with claim 16 wherein said coil spring latching mechanism further comprises a spring tension latching member that contacts an upward projecting portion of a left lower cradle portion V-rod when said coil spring latching mechanism is latched.

19. A cut tree stand in accordance with claim 18 wherein said coil spring latching mechanism further comprises a chain hooking portion extending from said coil spring.

20. A cut tree stand in accordance with claim 16 further comprising a plastic coated steel rod cut tree stand.

* * * * *